US005916042A

United States Patent [19]

Reimers

[11] Patent Number: 5,916,042

[45] Date of Patent: Jun. 29, 1999

[54] ADJUSTABLE BALANCE WEIGHTING SYSTEM FOR GOLF CLUBS

[76] Inventor: Eric W. Reimers, 1235 Starwood, Missoula, Mont. 59802

[ * ] Notice: This patent is subject to a terminal disclaimer.

[21] Appl. No.: 08/881,524

[22] Filed: Jun. 24, 1997

Related U.S. Application Data

[63] Continuation-in-part of application No. 08/541,026, Oct. 11, 1995, Pat. No. 5,683,309.

[51] Int. Cl.[6] ..... A63B 53/06

[52] U.S. Cl. ..... 473/334; 473/338; 473/349; 473/345

[58] Field of Search ..... 473/324, 333–339, 473/341, 349, 345

[56] References Cited

U.S. PATENT DOCUMENTS

| | | | |
|---|---|---|---|
| D. 154,496 | 7/1949 | Klein | 473/324 |
| 3,199,874 | 8/1965 | Blasing | 473/244 |
| 3,976,299 | 8/1976 | Lawrence | 473/327 |
| 4,052,075 | 10/1977 | Daly | 473/338 |
| 4,085,934 | 4/1978 | Churchwood | 473/338 |
| 4,195,842 | 4/1980 | Coleman | 473/337 |
| 4,411,430 | 10/1983 | Dian | 473/337 |
| 5,078,400 | 1/1992 | Desbiolles | 473/349 |
| 5,624,331 | 4/1997 | Lo | 473/345 |
| 5,746,666 | 5/1998 | Lovett | 473/328 |
| 5,749,793 | 5/1998 | Lucetti | 473/324 |

*Primary Examiner*—Steven Wong
*Assistant Examiner*—Stephen L Blau
*Attorney, Agent, or Firm*—Mark E. Baze; Larry B. Guernsey; Michael J. Hughes

[57] ABSTRACT

Adjustable balance weighting systems (10 and 110) are provided for adjusting the weighting and balance of golf clubs of either the "iron" or the "wood" types. An eccentric weighting means is mounted on or in the club head (14 or 74) so as to be rotatable and provide a mechanism by which the center of mass, and therefore the sweet spot, of the club head (14 or 74) may be varied. In the case of an iron-type club head (14), an eccentrically weighted disk (32) is mounted in a substantially vertical orientation on the rear face (24) of the club head (14). In the case of a wood-type club head (74), a similar disk (82) is mounted in a horizontal orientation in a recess (80 or 89) in a top or bottom surface (78 or 87) of the club head (74). When adjustment is needed, a screw (68 or 86) is conveniently loosened so that the disk (32 or 82) may pivot and be turned to a desired orientation, thereby causing more weight to be transferred to either the toe or heel of the club head (14 or 74), as necessary, to correct a "slice" or a "hook," respectively. In an alternative embodiment for wood club heads (112), eccentric weighting is provided by a rotatable sole plate (130) with an attached weight (156) eccentrically located thereon. In a further enhancement to the adjustable balance weighting system, there is also provided, in the case of wood clubs, an oversized club head (112) of a substantially ellipsoidal shape. The redistribution of weight afforded gives greater controllability and allows a more effective use of the already increased sweetspot provided by an oversized club head.

19 Claims, 10 Drawing Sheets

ADJUSTABLE BALANCE WEIGHTING SYSTEM FOR GOLF CLUBS

This is a continuation-in-part of U.S. application Ser. No. 08/541,026 filed on Oct. 11, 1995 now U.S. Pat. No. 5,683,309 by Eric W. Reimers and hereby incorporated by reference in its entirety.

TECHNICAL FIELD

The present invention relates generally to golf clubs, and more particularly to golf club heads having an adjustable weighting system for customizing the weight and balance of the golf clubs.

BACKGROUND ART

As anyone who has ever played and enjoyed the game of golf can relate, the sport has a great propensity to both simultaneously enthuse and frustrate. The seemingly simple task of swinging a golf club and hitting a golf ball is not at all simple, and in fact, the dynamics of properly hitting a golf ball are quite complex. The most desirable ball flight characteristics generally occur when the golf ball is struck with the "sweet spot" on the face of the club head, maximum impact and true flight occurring at that location. For a variety of reasons, it is often extremely difficult for a golfer to overcome his or her propensity to strike the golf ball at a point on the club head face that is not in alignment with the sweet spot, or center of mass of the club head. Even the best golfer may be unable to overcome a particular glitch in his or her swing that causes a recurring "hook" or "slice" or other unwanted ball trajectory, and it is especially true that the typical golfer will tend to hook the ball with the shorter clubs and slice with the longer ones. And even where the one problem is solved, another invariably rises to take its place. The foregoing is evidenced in the great inconsistency with which professional golfers win tour competitions, as well as in the rise of high-tech services that offer sophisticated sensor feedback and computer analysis in order to assist a golfer in correcting a problematic swing.

A number of prior attempts have been made in an effort to increase a golfer's ability to properly hit a golf ball. A common focus has been on the redistribution of weight across the back of the golf club head. So-called "perimeter weighting" provides a larger sweet spot and thus tends to be more forgiving when the ball is not struck in precise alignment with the center of mass of the club head. Still, the golfer is at the mercy of a sweet spot that has been designated by the club maker. If the golfer's average or usual contact point with the ball is away from the sweet spot, this arbitrary sweet spot is in the wrong place, and the average hit will not feel as good to the golfer as it might otherwise. Fixed perimeter weighting assumes a golfer's average swing is on the swing spot. It rarely is.

Thus, in addition to perimeter weighting, it is desirable to be able to change (move) the actual center of mass and, therefore, the sweet spot of the club head. Towards this end, a number of designs for weight balancing a club head have been proposed. Some of these designs, such as that shown in U.S. Pat. No. 5,026,056 issued on Jun. 25, 1991 to McNally et al., incorporate integral, fixed or otherwise permanent weights that are positioned to provide a sweet spot that correlates with the visual center of the club face. Such a design, while to some extent a helpful assist, is inflexible and does not permit the weighting of the club to be tuned to the swing of the individual golfer. And even where a fixed-weight club is customized for the individual, as noted, a golfer's swing is generally not a static phenomenon but rather changes, if only for temporary, frustrating periods of time.

Much better, then, are designs that permit adjustable weight balancing. A number of patents have issued for weighting schemes that share in common the characteristic of employing chambers that are drilled or hollowed at various angles into either an iron or a wood club head. See for example U.S. Pat. No. 4,867,458 issued on Sep. 19, 1989 to Sumikawa et al., U.S. Pat. No. 4,607,846 issued on Aug. 26, 1986 to Perkins, U.S. Pat. No. 4,145,052 issued on Mar. 20, 1979 to Janssen et al., and U.S. Pat. No. 3,979,122 issued on Sep. 7, 1976 to Belmont. A weight, in the form of a threaded screw, plug or metal powder, is inserted into a chamber and positioned to achieve the desired weighting and balance. These methods are clumsy and awkward to implement, and achieving a proper adjustment is not intuitively simple. The latter is especially true in light of the fact that it would appear to be difficult for the golfer to tell by visual observation alone the degree or extent to which any adjustment has been made by the aforementioned methods, the positioning of the weights being made within hidden recesses and/or there being no simple guide or reference markers that can be employed during adjustment.

Shown in U.S. Pat. No. 3,199,874, issued on Aug. 10, 1965 to Blasing, is a variable weighting system for a wood-type club head. Here there is provided a rotatable turntable within the club head which includes a cavity for containment of a quantity of elemental mercury. The cavity is configured to provide an eccentric weighting capability, wherein a greater quantity of mercury pools in the cavity at a distance removed from, rather than nearer to, the center of the turntable. With a hold down screw loosened, the golfer simply rotates the turntable (by moving an indicator prong on the upper surface of the club head) to reposition a heavier mass of mercury heelward or toeward to correct either a hook or slice, respectively. The rushing movement of the mercury toward the club face at impact with a golf ball also provides additional force impetus to the ball. While implementation of the described weighting feature is simple and adjustment is intuitive, modern day commercial use of the invention is highly problematic (if not illegal) because of the extreme health hazard presented by mercury and because its use and disposal are now so highly regulated. Moreover, because of the dynamic nature of the mercury, this type of club head would not be allowed for professional use by the United States Golf Association (U.S.G.A.).

In a further effort to increase the golfer's ability to properly hit the ball, golf club manufacturers have for some time also offered golf clubs with so-called "oversized" club heads. An oversized club lead, in similar fashion to a club head with perimeter weighting, provides that a larger sweet-spot is available such that the golf ball need not be struck precisely in alignment with the center of mass of the club head in order to achieve a tolerable shot. However, because the shapes of traditional club heads are not symmetrical, but are rather "pear" shaped in the case of woods, and "wedge" shaped in the case of irons, or of some otherwise unsymmetrical shape, and because golf club manufacturers have continued to adhere to these traditional golf club shapes in the production of oversized golf clubs, such oversized golf clubs as are presently made do not take full advantage of the increased club head size.

In particular, as the club head size becomes larger, the center of mass moves farther and farther away from the golf club shaft. This makes a draw harder to hit, and actually promotes a fade. In the case of woods, for example, an oversized, pear-shaped club head means that a relatively large area behind and back of the golf club shaft is not as fully weighted as it might otherwise be were the center of mass brought back to a location less removed from the shaft where an even greater area of an already increased sweetspot would be caused to be made available, thus obtaining greater control and a more favorable ball flight trajectory.

Because of the limitations associated with most presently available golf clubs, a substantial need still exists for a golf club that provides for an intuitively simple, efficient and easy method of weight balance adjustment. It would further be extremely desirable to provide for an oversized club head which offers a better weight distribution, preferably one into which such a simple method of weight balance adjustment might also be incorporated.

DISCLOSURE OF THE INVENTION

Accordingly, it is an object of the present invention to provide a golf club head having an improved mechanism for adjusting the weight and balance thereof.

It is another object of the invention to provide a golf club head with a method of adjusting the weight and balance that is simple and easy.

It is another object to provide a golf club head with a method of adjusting the weight and balance that is acceptable to the U.S.G.A.

It is a further object to provide a golf club head in which the sweet spot may be adjusted to correlate with a golfer's particular swing pattern and/or with the apparent visual center of the golf club face.

It is yet another object to provide for an adjustable balance golf club head in which adjustments in the weight and balance may be made in small, precise increments.

It is yet a further object to provide a method of adjusting the weighting and balance of a golf club that it applicable to a wide variety of golf clubs.

It is still another object of the present invention to provide an adjustable balance golf club that may be used as a "fitting" club.

It is a still further object to provide for an oversized club head for a driver or other "wood" which brings the center of mass closer to the shaft.

Briefly, the preferred embodiment of the present invention is a system for adjusting the weighting and balance of a golf club head of either the "iron" or the "wood" type. An eccentrically weighted balancing disk is mounted on (or in) the club head so as to be rotatable and provides a mechanism by which the center of mass, and therefore the sweet spot, of a club head may be varied. In the case of an iron, the balancing disk is mounted in a substantially vertical orientation in a recessed fashion on the back of a club head having, in preferred form, perimeter weighting. In the case of a wood, the balancing disk is mounted in a horizontal orientation in a recess in the top or bottom surfaces of the club head, or in an internal cavity within the club head, with an access aperture being provided therefor. In an alternative embodiment for wood club heads, eccentric weighting is provided by a removable sole plate with an attached weight eccentrically located thereon. When adjustment is needed, an Allen screw is conveniently loosened so that the balancing disk or sole plate may pivot and be turned to a desired orientation, thereby causing more weight to be transferred to either the toe or heel of the club head, as necessary, to cause the golf club to be in tune with the golfer's swing and/or to correct any deficiencies that may exist therein.

In a further enhancement to the adjustable balance weighting system, there is also provided, in the case of wood clubs, an oversized club head of a substantially ellipsoidal shape. This shape provides that a greater percentage of the mass of the club head, as compared to traditional pear shaped club heads, is brought nearer to the shaft. This redistribution of weight gives greater controllability and allows a more effective use of the already increased sweetspot provided by an oversized club head. The ellipsoidally shaped club head, especially in conjunction with the aforementioned eccentrically weighted sole plate, achieves weighting and balancing capabilities for the golfer of a level and ease as have heretofore been unattainable.

An advantage of the present invention is that adjustment using the weight balancing system is intuitively simple.

Another advantage of the invention is that adjustment of the balance and weighting of the golf club may be easily and rapidly carried out even during actual play on a golf course, although it is intended that this feature may be disabled in order to comply with competitive rules, once the optimum position for the golfer has been established.

A further advantage is that the weighing and balancing system may be adapted to the personal swing and style of essentially any golfer.

Yet another advantage is that the invention is adaptable to virtually any type of golf club.

Yet a further advantage of the present invention is that modifying the balance and weighting of a golf club is so facile as to encourage the regular and consistent use thereof.

Still another advantage is that where an easy adjustability is not desired or permitted (perhaps in U.S.G.A. play, for example), the golfer may be fitted using a golf club of the present invention in which subsequent to the fitting the balancing adjustment achieved thereby may be simply and easily made to be permanent.

A still further advantage is that more of the already increased sweet spot of an oversized golf club is caused to be brought into play and the club is made to be more controllable.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
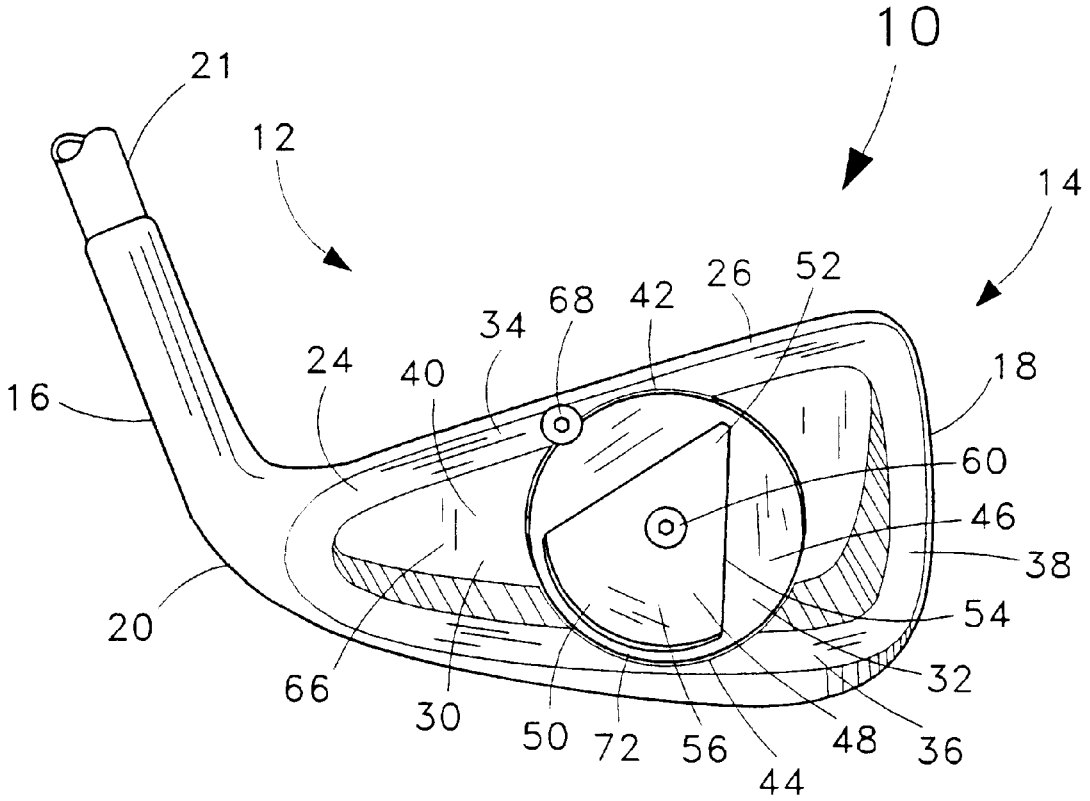
FIG. 1 is a rear elevational view of an iron-type club head of the preferred embodiment of the present invention.

The preferred embodiment of the present invention is an adjustable balance weighting system for a golf club head. The weighting system of the preferred embodiment is applicable to golf clubs of both the iron and the wood type and is set forth in FIGS. 1 and 6 of the drawings, where it is designated therein by the general reference character 10.

Figure 2:
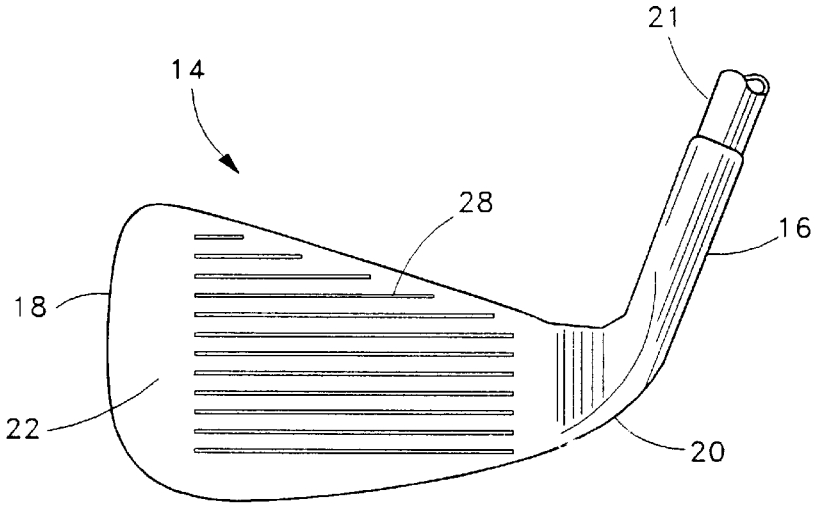
FIG. 2 is a front elevational view of the club head of FIG. 1.
Figure 3:
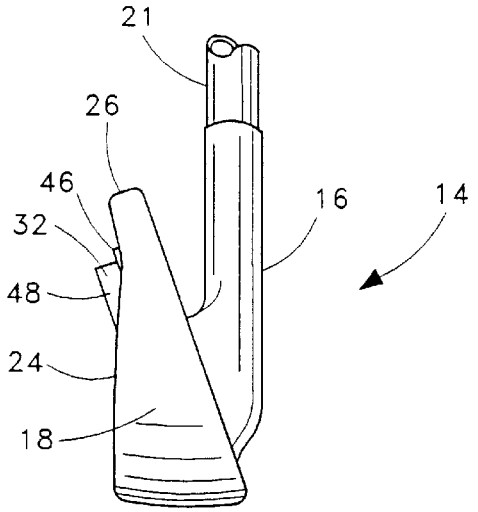
FIG. 3 is a toe end elevational view of the club head of FIG. 1.

Referring initially to the rear and front elevational views in FIGS. 1 and 2, respectively, a typical golf club 12 is shown having an iron-type club head 14. The club head 14 has a hosel 16 formed integrally therewith and also includes a toe end 10 and a heel end 20. The lower end of a club shaft 21 is connected to the hosel 16 in the usual manner. Extending longitudinally between the toe end 18 and the heel end 20 are a planar striking face 22 (FIG. 2), a rear face 24, and a narrow top surface 26. The striking face 22 is typically scored in conventional fashion with horizontal parallel lines 28. As is evident in the toe end view of FIG. 3, the striking face 22 slopes upwardly and rearwardly to form a loft angle, a different loft angle being provided for each numbered iron as is customary.

Figure 5:
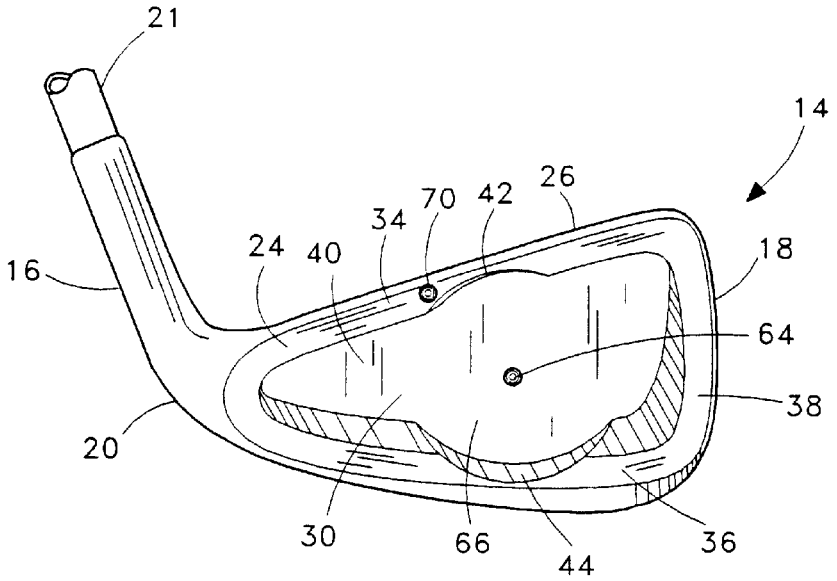
FIG. 5 is a rear elevational view of the club head of FIG. 1 with the balancing disk removed.

Referring specifically to FIG. 1 (and also to FIG. 5), it will be seen that the club head 16 has a cavity 30 formed in the rear face 24 thereof. Mounted within the cavity 30 is a balancing disk 32, the rotation of which, as will be described herein, provides for the adjustable balance nature of the golf club 12 of the present invention. The balancing disk 32 is positioned between and within an upper perimeter 34 and a lower perimeter 36. The solid outline as formed by the upper and lower perimeters (34 and 36), and by a toe end perimeter 38, constitute what is commonly referred to as "perimeter weighting," which is often present in modem golf clubs to give a larger sweet spot, as noted previously. The balancing disk 32 is rotatably mounted upon a cavity back wall surface 40 and resides within arcuate-shaped upper and lower recesses 42 and 44, respectively, that are formed in the upper and lower perimeters (34 and 36). To a certain degree, the upper and lower recesses (42 and 44) offer containment and stabilization of the balancing disk 32, and thereby, protection from inadvertent adjustment. The cavity back wall surface 40 against which the balancing disk 32 is flushly juxtaposed forms a plane that is parallel to the striking face 22. Thus, as is shown most clearly in FIG. 3, the balancing disk 32 of the preferred embodiment lies at an angle of inclination that is substantially identical to the striking face 22, although this will not always be the case, since some club heads are formed such that the front and rear surfaces are not parallel.

Referring again to FIG. 1, the preferred balancing disk 32 is comprised of a circular base portion 46 and a wedge portion 48 which are integrally fashioned together to form a structure that is "bi-level" in appearance. The balancing disk 32 has an eccentric weighting capability due to the wedge portion 49 which provides that more mass is present at an arcuate end 50 than at a vertex end 52. The amount of eccentric weighting offered by the balancing disk 32 can be easily varied by, among other possibilities, forming a balancing disk 32 with a narrower or wider wedge portion 48, by forming wedge portion sides 54, that are not straight as depicted, but rather arcuate, or by forming the wedge portion 48 with a wedge portion top surface 56 that slopes in some fashion from the vertex end 52 to the arcuate end 50, thereby increasing the mass differential of those two ends. Further, and particularly for aesthetic purposes, it may be desirable to internalize the eccentricity such that the exterior appearance of the balancing disk 32 is uniform (except for unobtrusive markings to indicate the location of the eccentric weighting).

Similarly, where a particular golfer's style of play requires a heavier or a lighter club head, the total mass of the balancing disk 32 may be varied, for example, by providing a thicker base and/or wedge portion (46 and/or 40), or by providing a balancing disk rear surface 58 (FIG. 4) that is either planar or hollowed, with a degree of concavity as corresponds to the amount of mass deemed desirable to be removed. The ability to alter the weight of the club head 14 in this manner has an especially useful application when a golfer wishes to exchange a club shaft made of graphite for one made of steel, or vice versa. Currently, a golfer who decides that he or she prefers, for example, steel over graphite, cannot have his or her golf clubs re-shafted and still maintain a proper swing weight. The weight can be brought into line by having available a second set of heavier or lighter balancing disks 32.

It will thus be seen, and as would be apparent to one with ordinary skill in the art, that there are a great number of shapes that might be employed for the balancing disk 32 in order to yield the desired eccentric and total weighting results. Therefore, it is not intended that the weighting system 10 be limited to a disk of the structure as depicted for the preferred embodiment presently known. By way of further example, the "wedge" portion 48 need not in fact be a wedge. The desired eccentric weighting could be provided by a second disk-shaped or other solid geometric structure fashioned off-center and on top of the base portion 46. Likewise, the base portion 46 need not be circular, i.e., the balancing "disk" 32 need not be a disk but could be some other geometric shape. Moreover, to achieve an eccentric weighting capability, it is not necessary, of course, that a bi-level structure be used. A purely wedge-shaped or other eccentrically weighted structure shape could be equally employed where that structure is rotatably or swingably mounted in a suitable fashion. A purely wedge-shaped weight, for example, also allows for more weight to be moved and redistributed about the club head 14. In the vein of the forgoing, it is important to note that an eccentric weight need not actually be employed to achieve an eccentric weighting capability. A weight of non-eccentric design may be used where that weight is mounted in an eccentric fashion. Thus, for example, a disk-shaped weight may be mounted off-center, and an elongated weight may be mounted so as to be biased towards one end in order to create the desired eccentric weighting and balancing upon rotation of such weights about their eccentric mounts.

Figure 4:
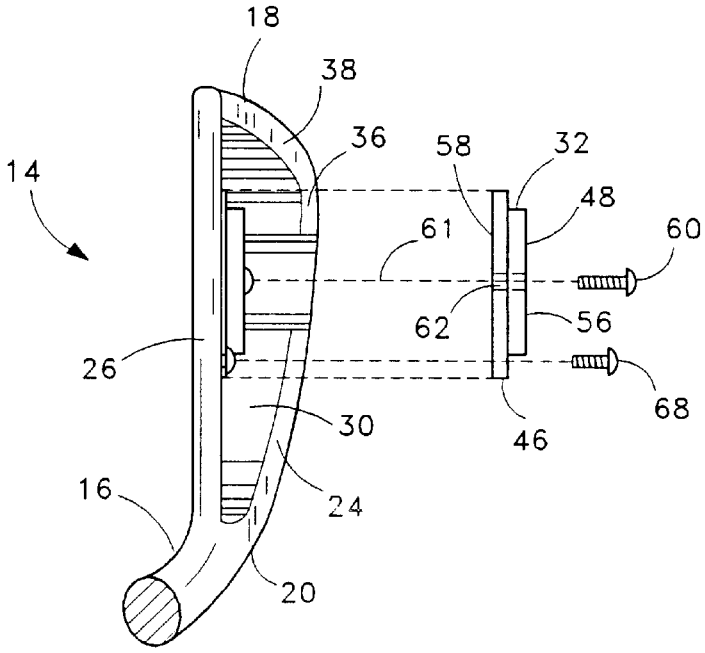
FIG. 4 is a top view of the club head of FIG. 1 showing an exploded view of the balancing disk.

Referring again to FIG. 1, and also to the top plan view provided by FIG. 4, as noted previously, the balancing disk 32 is rotatably mounted onto the cavity back wall surface 40. A first Allen screw 60 that passes through a centrally located aperture 62 (see FIG. 4) in the balancing disk 32 and that is screwed into a first threaded receiving hole 64 (see FIG. 5) present in a cavity back wall 66 provides this rotatable mounting. The first Allen screw 60 is of a length such that it may be screwably tightened within the first threaded receiving hole 64 without bearing down upon the wedge portion top surface 56. Thus, the first Allen screw 60 defines a center of rotation (origin) about which the balancing disk 32 is free to rotate when adjustment is desired. Ideally, such a center of rotation is situated as close as possible to the original center of mass of the club head 14, with a rotation axis 61 for the balancing disk 32 being ideally perpendicular to the striking face 22. (This rotation axis 61 is shown in FIG. 4 as corresponding to the dashed line drawn to show the insertion manner of the first Allen screw 60.) This minimizes the number of balance parameters affected by rotation of the balancing disk 32.

In the weighting system 10 of the preferred embodiment, a second Allen screw 68 holds the balancing disk 32 in place during play. The second Allen screw 68 is screwed into a second threaded receiving hole 70 strategically located at a point in the upper perimeter 34 such that the head of the second Allen screw 68 is able to overlap and thereby bear down upon a base portion outer periphery 72, the thickness of the base portion 46 of the balancing disk 32 extending slightly beyond that of the upper perimeter 34 in order to accommodate this mode of holding. It should be noted, of course, that if the first Allen screw 60 is designed to be sufficiently snug, the second Allen screw 68 is made unnecessary. However, with respect to the iron club head 14 embodiment as shown, where access is not an issue, the extra security provided by the second Allen screw 68 is desirable. Not shown in the drawings is that it may also be desirable to introduce a rubber grommet or rubber washer behind the balancing disk 32 in order to reduce concussionatory vibrations that might otherwise cause a loosening of the balancing disk 32.

It must be noted that, for certain applications, the preferred embodiment of the present invention may in fact present a manner of adjustment that is actually too simple and easy for the golfer. Professional golf associations (e.g., the U.S.G.A.) may not allow a golf club which has a means of adjusting the balance that is as simple and expedient as that provided by the present invention, and which might possibly create an unfair advantage. In this case, the aforementioned Allen screws (60 and 60) might only be used for fitting purposes by a golf pro shop. That is, rotatable balancing disks 32 would be employed during a fitting to find the optimum position for the balance and weighting of the different club heads 14 as comprise a typical set of golf clubs 12, then the pro or fitter would "permanently" affix the balancing disks 32 (or perhaps a matching set of balancing disks 32 not provided with aperture 62) using, for example, an epoxy glue. If necessary, the balancing disks 32 could be reset at a later date using heat in a manner similar to re-shafting a golf club. Similarly, the adjustable balance weighting system 10 might be employed with a set of clubs used by a golf pro shop and designated for fitting purposes only. These "fitting clubs" would be used to optimize balance and weighting, and then a second set of playable golf clubs would be ordered from the factory manufactured to those specifications. Another possibility for limiting adjustability is to provide a "semi-permanent" mounting using screws which have a specially slotted screw head of a design not commonly available (similar to a TORX screw, for example). This would require the golfer to go back to the shop for adjustment. A semi-permanent mounting could also be achieved by requiring that two tools necessitating the use of two hands be needed to make any adjustment and wherein a third hand or a vice would then be necessary to hold the golf club 12 during the adjustment process.

Figure 6:
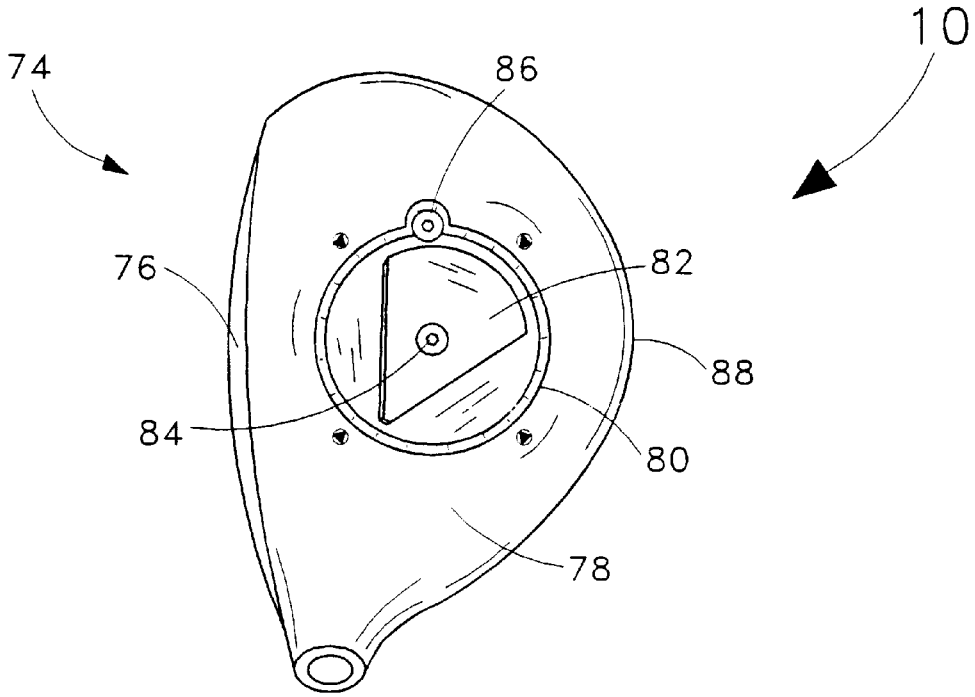
FIG. 6 is a top view of a wood-type club head incorporating the preferred embodiment of the present invention.
Figure 7:
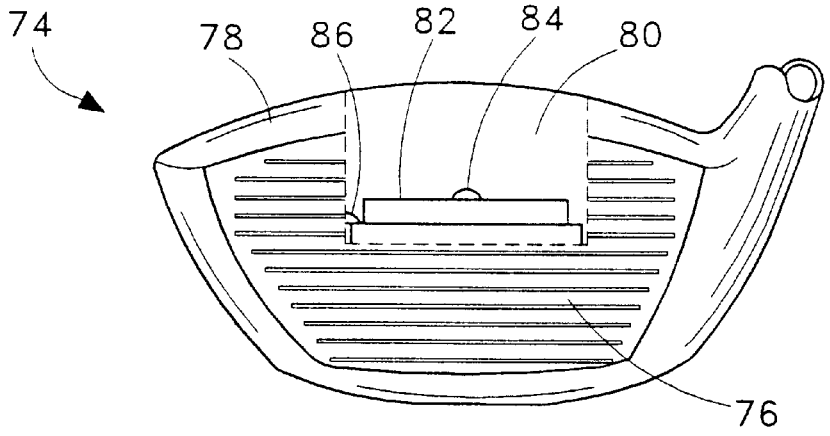
FIG. 7 is a front elevational view of the club head of FIG. 6 revealing the otherwise hidden recess within which the balancing disk is employed.

Shown in the top plan view of FIG. 6 and in the front elevational view of FIG. 7, is a wood-type club head 74 that also incorporates the weighting and balancing system 10 of the present invention. The club head 74 has attributes similar to those found in the iron-type club head 14, including a scored striking face 76. As is customary, the wood-type club head 74 departs from the iron-type club head 14 in having a much wider top surface 78. In this top surface 78 a recess 80 is provided within which a balancing disk 82 lies. The balancing disk 82 is of essentially identical construction to the balancing disk 32 of the iron-type club head 14. The balancing disk 82 is also rotatably mounted in an essentially identical fashion to the balancing disk 32, the only difference being that the mounting has a horizontal, as opposed to vertical, orientation. As with the iron-type club head 14, first and second Allen screws 84 and 86 are used to provide both a rotational mounting axis and a hold down mechanism, respectively. The placement of the balancing disk 82 within the club head 74 is such as to closely correlate with the center of mass of the club head 74. A plug (not shown) made of wood or metal may be used to conceal the recess 80 and prevent the entry of dirt and other foreign matter therein.

Figure 7A:
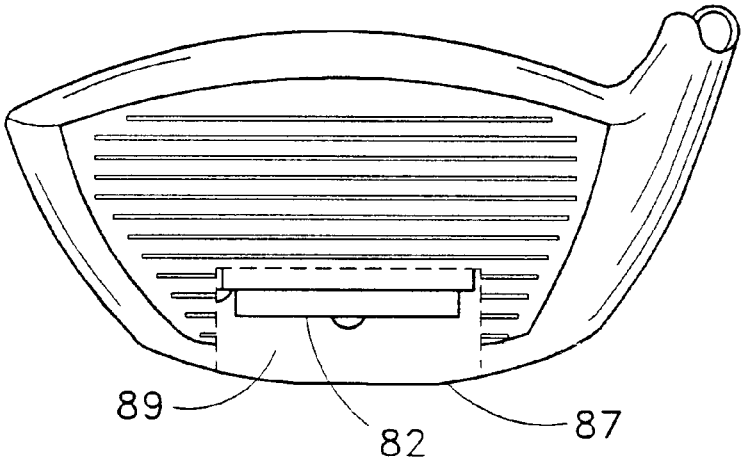
FIG. 7*a* is a front elevational view of a club head similar to the club head of FIG. 7 but with the recess having been relocated to the bottom surface of the club head.

As shown in FIG. 7*a*, it is apparent that a bottom surface 87 could equally well incorporate a recess 89 similar to recess 80 for accommodation of the balancing disk 82. In this case, all evidence of the adjustable nature of such a golf club would be completely hidden from view and a plug would not be needed to provide for concealment, although such might be desirable, especially in the case of a "fairway wood," to prevent entry of dirt and other foreign material into the recess 89 and into the interface of the balancing disk 82 therewith.

In an alternative manner of so horizontally situating the balancing disk 82, it is contemplated that a horizontally oriented slot (not shown) may be provided for placement of the balancing disk 82 within the club head 74 instead of the recess 80. Such a slot would have a generally rectangular opening and be of a size to accommodate a sideways insertion of the thickness of the balancing disk 82. The opening of the slot would be located at the desired vertical elevation in a rear portion 88 of the club head 74 and the slot would extend horizontally within the club head 74. A slot of this nature reduces the amount of wood (or metal) that must be removed for placement of the balancing disk 82 within the club head 74, as compared to the embodiment which utilizes the recess 80, since the thickness of the balancing disk 82 is substantially smaller than that of the diameter of the balancing disk 82. Only a very narrow vertical shaft(s) centered in the club head 74 need then be provided for adjustment of an Allen screw(s).

Figure 8:
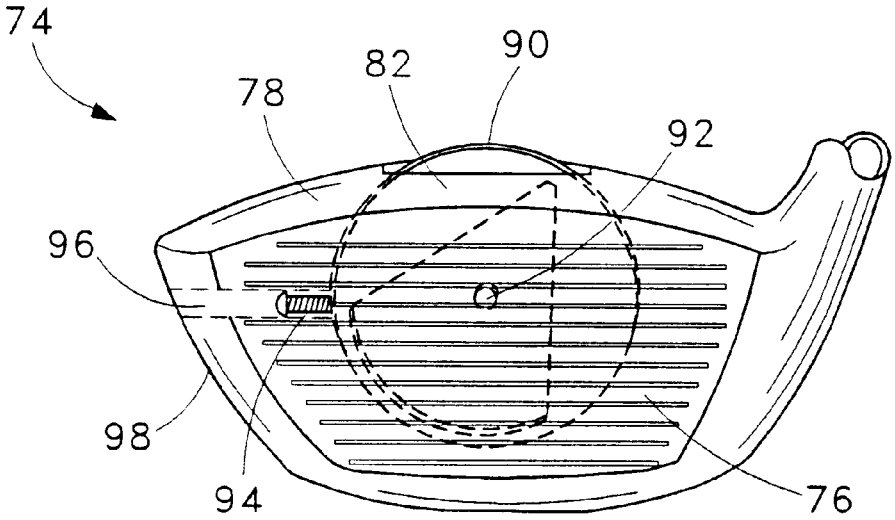
FIG. 8 is a front elevational view of a wood-type club head showing an alternative "thumbwheel" arrangement for the balancing disk.

Of course, the balancing disk 82 can also be mounted vertically on the rear portion 88 of the club head 74 in a manner similar to that previously described for the iron-type club head 14. In addition, and as is shown in the alternative embodiment of FIG. 8, a vertical mounting can be made within the club head 74 such that, for example, a balancing disk edge 90 is allowed to extend slightly above the top surface 78 in order to permit a "thumbwheel" type of adjustment. Such a vertically oriented balancing disk 82 rotates upon an axle 92. An Allen screw 94 located within a narrow shaft 96 is provided to be screwably tightenable against the balancing disk edge 90 to thereby hold the balancing disk 82 in position. The shaft 96 is shown as extending horizontally inward from a toe portion 98, but such a shaft could extend into the club head 74 from the rear portion 88 or heel as well.

While in the drawings the iron- and wood-type club heads (14 and 74) are shown as employing only a single one of the balancing disks 32 (or 82), it is to be understood that more than one such balancing disk 32 (or 82) could be incorporated into either of the different club heads (14 and 74) and thereby provide a more complex weighting pattern and ability. For example, in the case of the iron-type club head 14, two balancing disks 32 could be mounted in side-by-side fashion on the cavity back wall surface 40, each balancing disk 32 being independently mounted and held. Likewise, two balancing disks 82 could be mounted on the wood-type club head 74, both in the top surface 78, or one in the top surface 78 and one vertically upon the rear portion 88.

It is to be further understood that the balancing disk 32 (the following applies in analogous fashion to the balancing disk 82 as well) may be rotatably mounted by a method other than by employment of either the aperture 62 within the balancing disk 32 or the first Allen screw 60. It would be apparent to one with ordinary skill in the art that a more permanent pin or rivet type of mounting might be employed in place of the first Allen screw 60, although the use of a fastener like an Allen screw allows for an easy removal and replacement by the golfer of the balancing disk 32 for purposes of conveniently modifying the total and/or eccentric weighting. Moreover, rotatable mounting of an eccentric weight such as the balancing disk 32 need not be accomplished with an aperture- and pin-type arrangement. The balancing disk 32 could also be retained by small brackets or arms that would extend from the cavity back wall surface 40 or from the upper and lower perimeters (34 and 36) of the iron-type club head 14, or from the top surface 78 of the wood-type club head 74, that would hold the base portion outer periphery 72 of the balancing disk 32 while still permitting rotation thereof. Portions of the upper and/or lower perimeters (34 and 36), or of the top surface 78, of the iron- and wood-type club heads (14 and 74), respectively, could also be made to be detachable and/or slotted to provide the desired rotatable retainment and also to allow for longitudinal movement as will be described immediately following.

It is to be understood that provision may be made for the mounting of the balancing disk 32 to allow for longitudinal adjustment in addition to the axial adjustability already described. For example, with appropriate lengthening of the upper and lower recesses (42 and 44) of the iron-type club head 14, more than one first and/or second threaded receiving hole (66 and 70) could be employed to allow for longitudinal positioning of the balancing disk 32 at multiple sites towards or away from the toe and heel end (18 and 20) of the club head 14, thereby providing a more biased balancing than could otherwise be achieved by simple rotation of an eccentric weight. The recess 80 of the wood-type club head 74 could be similarly adapted.

With either of the balancing disks (32 or 82), and with respect to any of the aforementioned embodiments of the weighting system 10, it is contemplated that a conventional ratcheting type of mechanism may be incorporated and used during the rotatable adjustment of the balancing disks (32 and 82) to provide for an especially precise, incremental adjustment.

Shown in the views of FIGS. 9–14, is a weighting and balancing system 110 which departs somewhat from that described previously, but for which the operative concept is entirely similar. In this case, the weighting system 110 is shown as applied to an oversized wood-type club head 112 of a design that is itself novel and which also assists in the achievement of an optimized club head weight distribution.

The oversized club head 112 has sore attributes similar to those of the traditionally shaped wood-type club head 74. Thus, and referring now to the top view of FIG. 9 and the front view of FIG. 10, there is included a scored and lofted striking face 114, a hosel 116, and a shaft 118. Further, a toe end 120, a heel end 122, a top surface 124, and a rear face or surface 126 may also be defined and are readily apparent. The club head 112 is of the "metal wood" variety and is hollow, as is typical, with an interior portion 127 (see FIG. 13).

Figure 11:
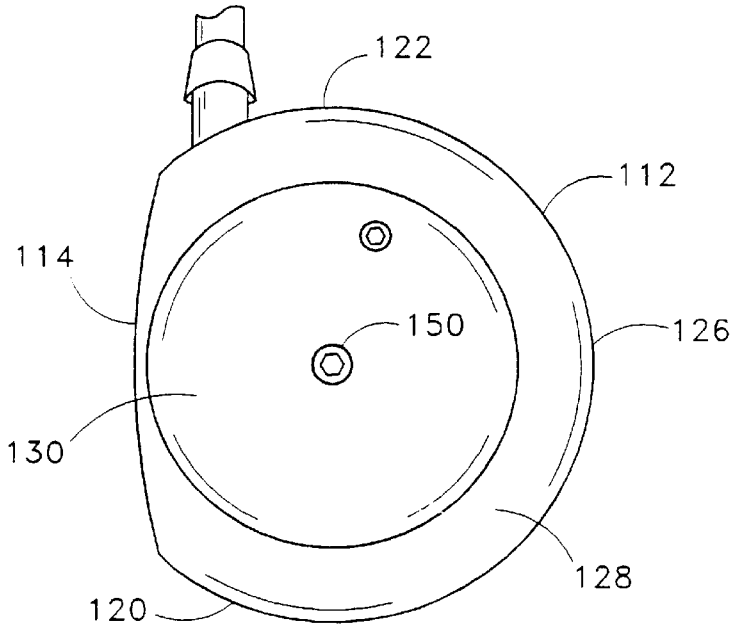
FIG. 11 is a bottom view of the club head of FIG. 9.

As shown in the bottom view of FIG. 11, there is present upon a bottom surface 128 of the club head 112 a sole plate 130. Sole plates are commonly employed with wood-type club heads. However, the sole plate 130 as comprises most of the bottom surface 128 is completely uncommon in a number of respects. The sole plate 130 has an arcuate or convex aspect so as to complete the impartation to the club head 112 of a substantially ellipsoidal shape, as opposed to a traditional wood-type club head which has a pear shape (when viewed from above—see FIG. 6) and further has a sole plate that is substantially flat or only very slightly rounded. Moreover, the sole plate 130 is eccentrically weighted and is made to have both a removable and a rotatable capability to provide the mechanism by which actual adjustment of the weighting and balancing of the club head 112 is carried out, as will be described below.

Figure 10:
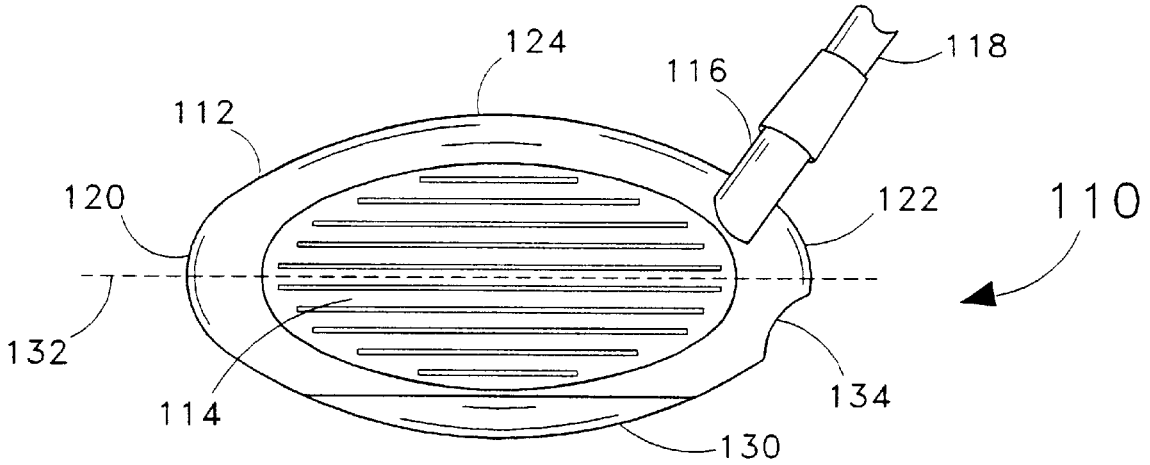
FIG. 10 is a front view of the club head of FIG. 9.

The near ellipsoidal shape of the club head 112 is especially evident in the front view of FIG. 10. In that drawing figure, a plane of symmetry is defined by a first bisecting line 132. Above and below the plane of symmetry are two halves that are substantially equivalent in shape and which are generally mirror images of one another. Some disruption of symmetry is present due to the hosel 116 which is attached at a transitional area between the top surface 124 and the heel end 122, and because of a depression or indentation 134 which is present to provide some measure of reinforcement to the hosel 116 attachment internal of the hollow club head 112.

Figure 9:
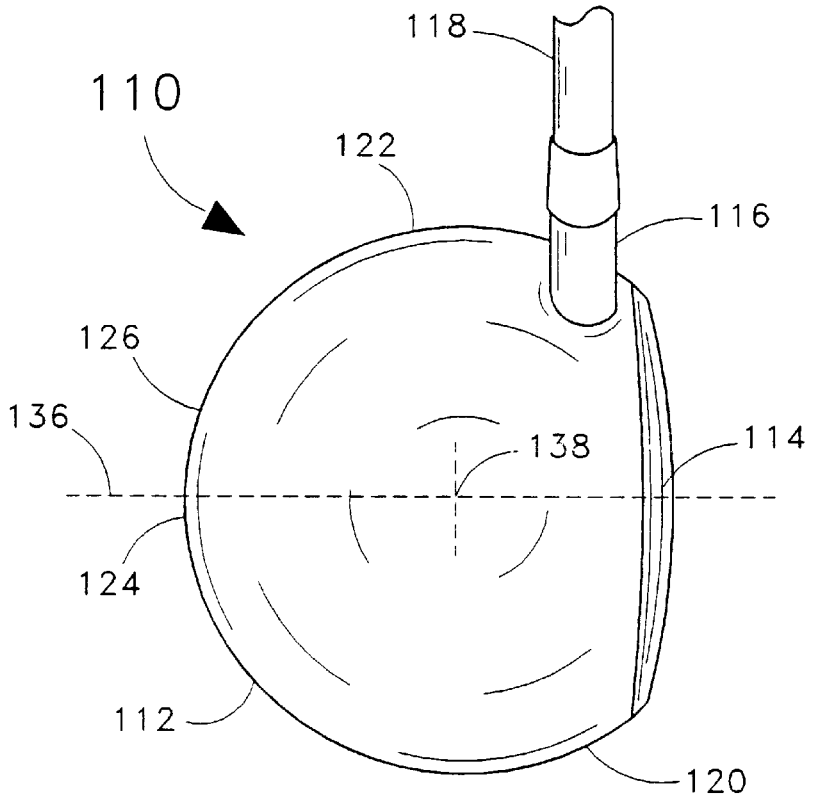
FIG. 9 is a top view of the oversized embodiment of the present invention.

As is evident from the top view of FIG. 9, were it not for the necessary abbreviation of shape caused by the substantially planar striking face 114, the club head 112 of the preferred embodiment would appear perfectly round when viewed in that orientation. In this drawing figure, a second bisecting line 136 passes through a center point 138 (marked by a short dashed line orthogonally bisecting the second bisecting line 136) and again defines a plane of symmetry and presents two substantially equivalent toe and heel end (120 and 122) halves. It is especially apparent in the view of FIG. 9 that this round shape places a large amount of weight behind the shaft 116 in the direction of the rear surface 124, as compared to the traditional pear shape (FIG. 6).

As has been mentioned earlier herein, this weight placement is especially beneficial in the case of an oversized club head in that it helps to bring the center of mass closer to the shaft 118, a proper distribution of weight having been lost in the movement by manufacturers toward oversized club heads where the traditional pear shape has been unwittingly retained. The redistribution of weight provides that even more of the already enlarged sweetspot that is offered by an oversized club is available for striking the ball on a desirable straight trajectory, and that greater controllability of the golf club is obtained.

Although the substantially ellipsoidal shape as shown is the presently preferred shape, other oversized shapes which provide for more equivalently weighted toe and heel end (120 and 122) halves and/or which cause more weight to be shifted nearer or behind the shaft 116 may also be employed. Thus, a squarish, somewhat boxlike shape with rounded corners will also achieve the more desirable redistribution of weight toward and behind the shaft 116.

Figure 12:
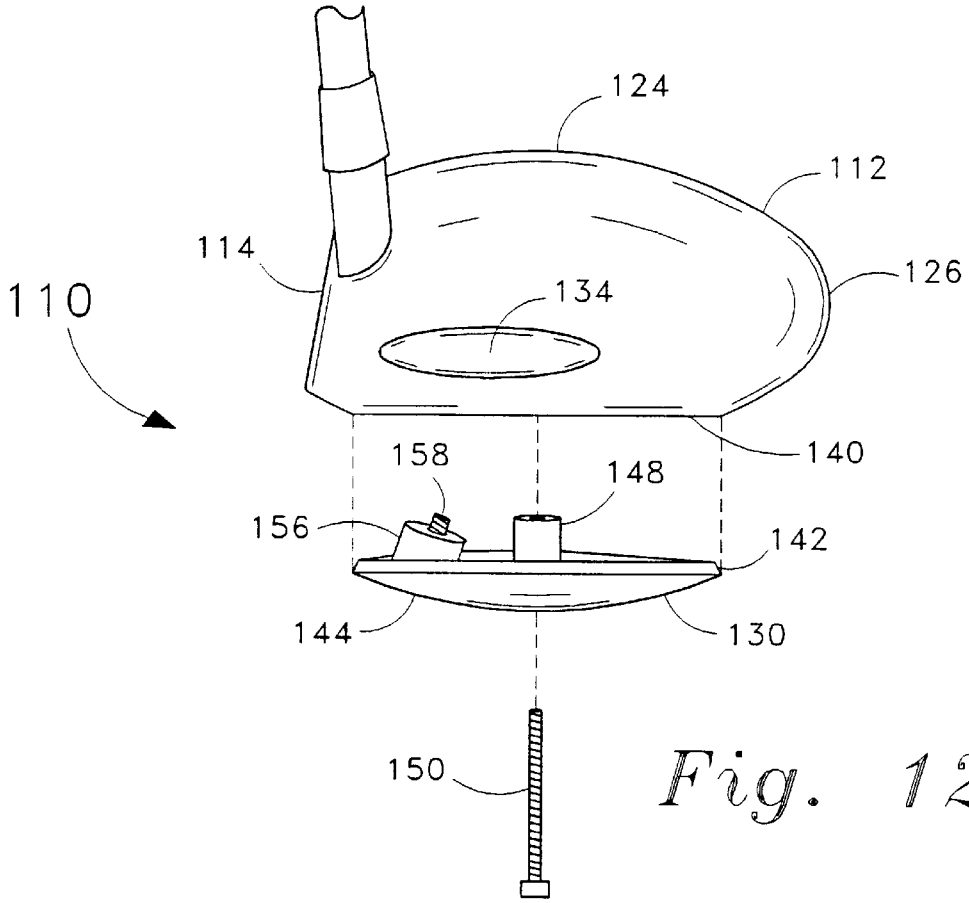
FIG. 12 is a partially exploded heel view of the club head of FIG. 9.
Figure 13:
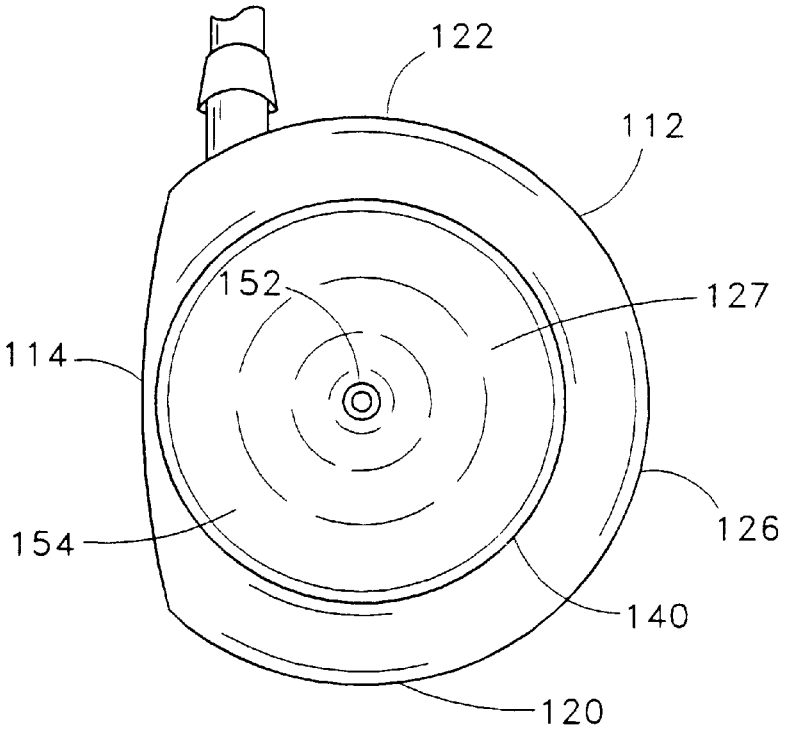
FIG. 13 is a bottom interior view of the club head of FIG. 9.
Figure 14:
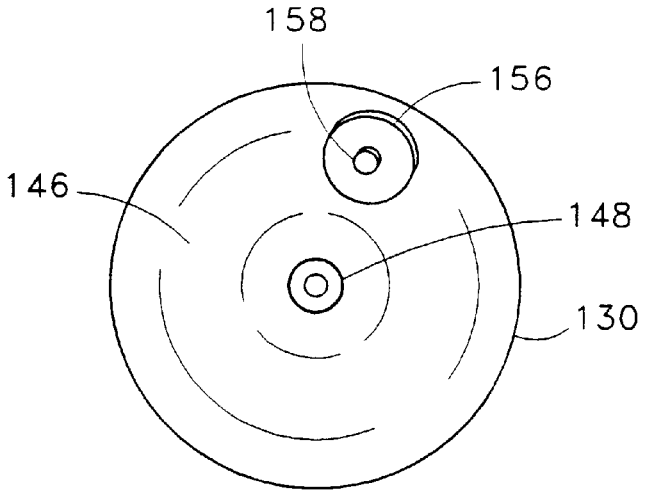
FIG. 14 is a (top) view of the interior surface of the sole plate.

Referring now to the views of FIGS. 12, 13 and 14, the sole plate 130 is shown to be a removable saucer- or dome-shaped structure which fits snugly and mateably within a large aperture 140 fashioned in the bottom surface 128 of the club head 112. The reception of the sole plate 130 within the aperture 140 is assisted by a slightly beveled edge 142 located at the circumference of the sole plate 130 which provides a fit similar to a lid upon a tea pot. The sole plate 130 includes an exterior surface 144 and an interior surface 146. A threaded first screw guide 148 is centrally located within the sole plate 130 and extends upward from the interior surface 146.

As shown in the bottom view of FIG. 11 and the partially exploded view of FIG. 12, the sole plate 130 is securely yet removably fastened to the club head 112 with a first Allen screw 150 which is of a sufficient length to extend through the first screw guide 148 and into a threaded second screw guide 152 which is centrally located upon and depends from an interior undersurface 154 of the top of the club head 112 (see FIG. 13). This attachment provides that the sole plate 130 can be adjusted by loosening the first Allen screw 150, lifting the sole plate 130 slightly out of the aperture 140, rotating the sole plate 130 to any desired new position, and then re-tightening the first Allen screw 150 to lock the sole plate 130 in place.

Referring now to both FIGS. 12 and 14, attached to the interior surface 146 of the sole plate 130 and located radially distant from the first screw guide 148 is a cylindrical weight 156. In the presently preferred embodiment, the attachment of the weight 156 is made with a second Allen screw 158 which extends through the sole plate 130 and into the body of the weight 156. The weight is made to be removable so that other sizes of weights (or no weight at all) may be employed as necessary to achieve the weighting and balancing capability desired.

It will now be apparent that the combination of the sole plate 130 and the attached weight 156 provides an eccentric weighting capability quite similar to that of the balancing disks (32 and 82) previously described. Upon rotation or repositioning of the sole plate 130, the weight 156 is also caused to be repositioned about the center point 138 forward or aft of (or in alignment with) the second bisecting line 136 to correct a slice or hook as necessary. The inventor has termed this particular embodiment of the eccentric weighting systems (10 and 110) as the "satellite" club (driver) in accordance with the celestial nature of the weighting mechanism and the overall appearance of the club head.

It will be noted that the sole plate 130 could also be provided with a wedge-shaped weight as found in the balancing disks (32 and 82) which would be attached to the center of the interior surface 146 of the sole plate 130—in place of the radially distant weight 156—to achieve the eccentric weighting. With a wedge-shaped weight or other similarly unbalanced shape or method, the option would exist to turn either of the sole plate 130 or just the weight itself to adjust the balance of the club head 112. Further, the sole plate 130 may be made to be removable not for the purpose of being rotatable, but to provide access to a balancing disk such as the previously described balancing disks (32 and 82) which would be appropriately mounted within the interior portion 127 of the club head 112, as opposed to the recessed systems used in conjunction with the club head 74.

Although a round sole plate 130 is presently preferred, it is apparent that sole plates of other shapes might be employed. A square shaped sole plate, for example, could accommodate four weight positions between which such a sole plate could be oriented. And, of course, any shape would be suitable where a removable sole plate was simply acting as portal for access to (or support for) a balancing disk such as balancing disks (32 and 82).

Further with respect to shape, it will be apparent that the eccentric weighting sole plate methodology of the present invention could be utilized with a club head of a conventional, rather than elliptical shape and still obtain many of the advantages that are afforded by the elliptical shape and eccentric weighting combination described.

An added benefit to the club head 112 having a removable sole plate 130 is that it eliminates the need for welding. Typically, a titanium driver consists of two cast pieces—a head and a sole plate. These must be welded together, which is difficult, expensive and less efficient than a sole plate which is simply screwed on to lock it in place. Further, the weld bead on the interior of a welded club head occasionally breaks off, especially after extended use. This piece can create a rattle that is disconcerting to the golfer.

Figure 15:
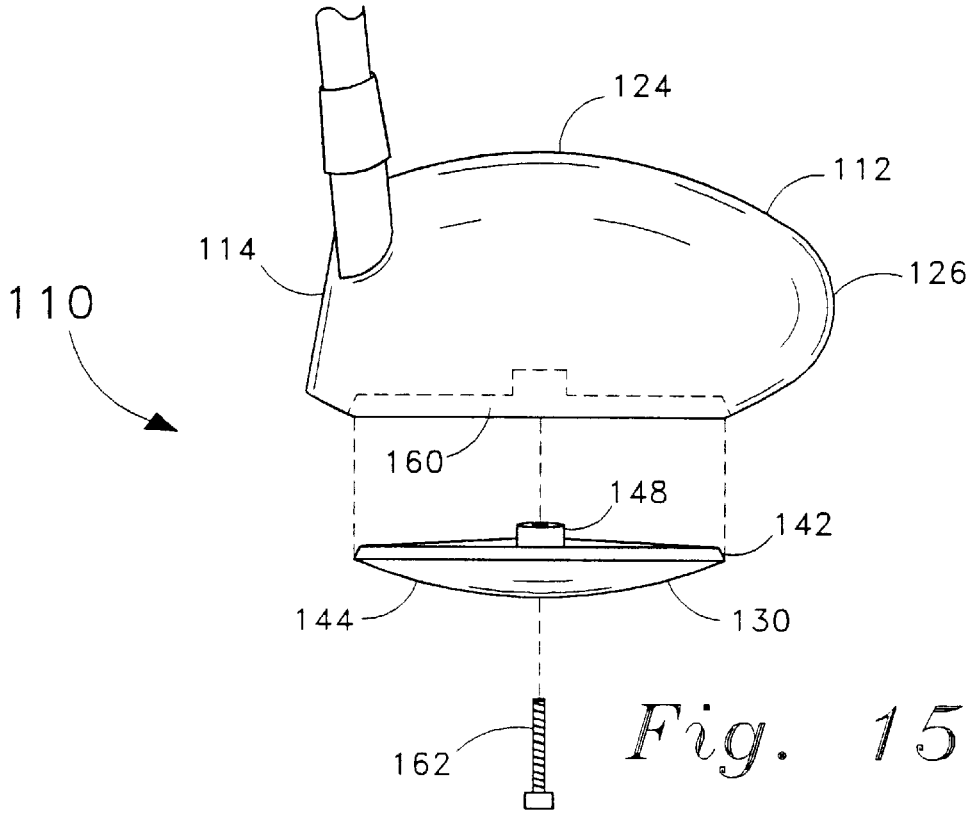
FIG. 15 is a heel view of a variation on the club head embodiment shown FIG. 9 in which a fitted recess is provided for reception of the sole plate.
Figure 16:
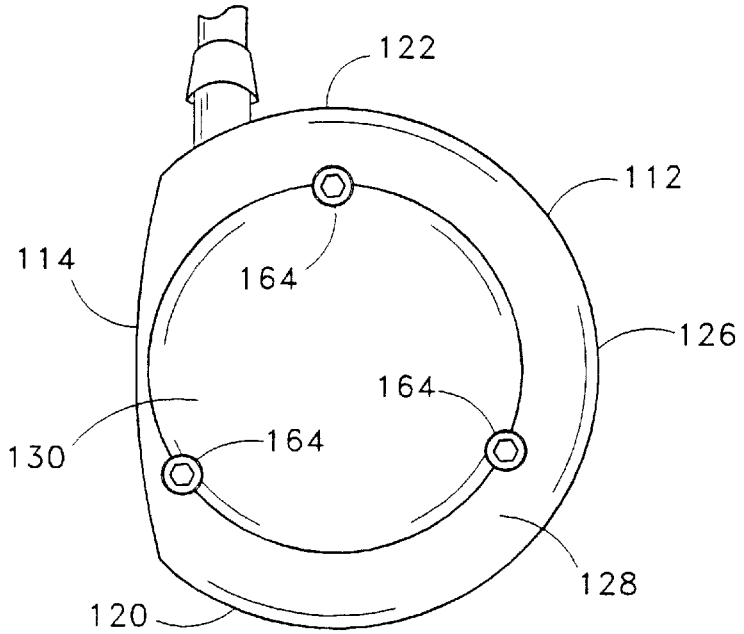
FIG. 16 is a bottom view of a further variation on the club head embodiment shown FIG. 9 in which attachment screws are located about the perimeter of the sole plate.
Figure 17:
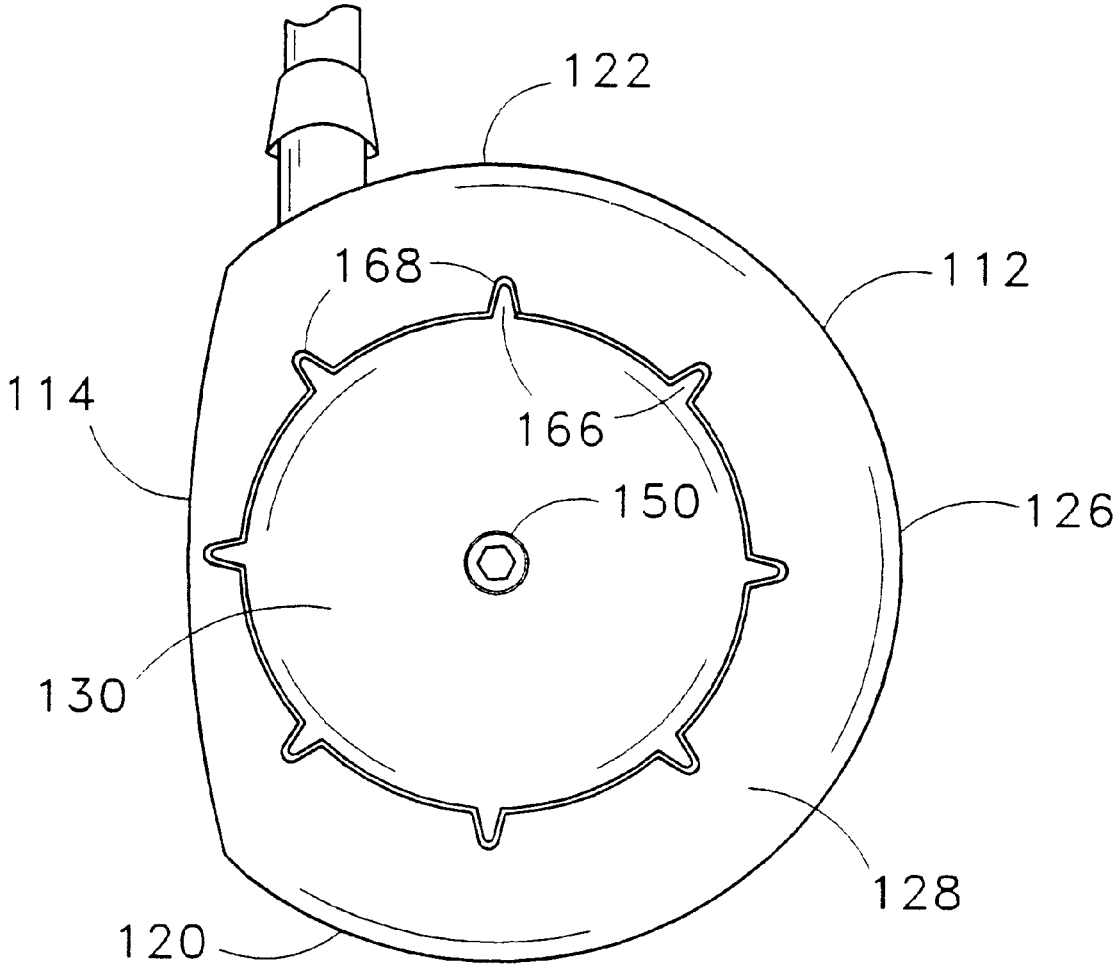
FIG. 17 is a bottom view of still another variation on the club head embodiment shown FIG. 9 in which an indexing feature is provided.

Additional possibilities for attachment and/or interaction of the sole plate 130 with the club head 112 that are within the purview of the present invention are shown in FIGS. 15, 16, and 17. As shown in the further embodiment of FIG. 15, rather than have the sole plate 130 located within the open aperture 140 and attached with the lengthy screw 150 to the top, interior undersurface 154 (as previously shown in FIG. 12), the option exists to instead locate the sole plate 130 within a hollowed (closed) recess 160 to which the sole plate 130 is then inserted and attached with a shorter screw 162. This manner of attachment should result in a generally more solid club head 112. Note that is this case, the weight 156 is made to be of a lower profile and is no longer visible above the perimeter of the sole plate 130 in the view depicted.)

As shown in still another embodiment in FIG. 16, rather than have the sole plate 130 be attached to the club head 112 by the centrally located screw 150 (or 162) and about which the sole plate 130 may rotate, a number of screws 164 may be positioned for holding purposes about the perimeter of the sole plate 130. This attachment method also allows for rotation of the sole plate 130 (in a similar fashion to a lid upon a teapot) upon slight loosening of the perimeter screws 164. Again, this manner of attachment may provide increased durability.

As shown in yet another embodiment in FIG. 17, the sole plate 130 may also be provided with small, laterally directed protrusions or extensions 166 that integrally radiate from the perimeter of the sole plate 130 in regular angular increments. The extensions 166 are received by corresponding notches 168 that are present in the bottom surface 128 of the club head 112. These extensions 166 and notches 168 provide an indexing function to allow for stepwise rotation of the sole plate 130 in precise, known angular increments during adjustment. Further, the "locking" interaction between the extensions 166 and notches 168 also prevents the sole plate 130 from moving upon repeated impact.

A variation (not shown) on the embodiment just described is to provide a similar indexing and enhanced retaining capability by way of a number of small protuberances ("bumps") which again are integral but which extend vertically (as opposed to laterally) about the perimeter of the sole plate 130. These protuberances would then mate with corresponding indentations provided in the roof of a recess similar to that described with respect to the embodiment of FIG. 15.

The weighting systems 10 and 110 of the preferred embodiment as presently known may be made from a variety of metals and metal alloys, such as steel, brass, and titanium, or from combinations thereof. Other materials of sufficient density may also be employed to achieve the eccentric weighting and to provide the degree of corrosion resistance that is desired.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The weighting and balancing system 10 of the present invention is designed to be used with any type of golf club. Thus, any or all of the irons, woods and wedges which comprise a set of golf clubs as is typically carried by a golfer may incorporate the weighting and balancing system 10. The weighting and balancing system 110 is designed primarily to be used with wood-type club heads, and in particular, the driver.

Use of the weighting and balancing systems (10 and 110) is simple. Where the golfer finds in the course of a game or practice session that his or her swing is such as to tend to hook or slice the ball correction may be easily made, in the case of an iron-type club, by simply unscrewing the second Allen screw 68 and then rotating the balancing disk 32 about the rotation axis 61 towards or away from the toe end 18 or the heel end 20. A slice is subject to correction by rotating the balancing disk 32 so as to distribute more mass (i.e., the arcuate end 50 of the wedge portion 40) towards the toe end 18, while a hook is correctable by rotating the balancing disk 32 to move more mass toward the heel end 20. (The positioning of the balancing disk 32 as drawn in FIG. 1 is so as to demonstrate the correction of a hook.)

In the case of the oversized "wood" club head 112, correction is equally simple. The golfer simply loosens the first Allen screw 150 (or perimeter screws such as 164 of FIG. 16) and rotates the sole plate 130 in the favorable direction to change the weight balance of the club head. Engraved radial markings (or notches such as 168 of FIG. 17) may be present upon the bottom surface 128 of the club head 112 which in conjunction with a single such mark on the sole plate 130, provide a visual indicator to allow the golfer to literally "dial in" the desired swing effect.

The only tool a golfer need carry to perform any adjustment is a small Allen wrench which can be conveniently kept in the golf bag, or attached thereto, at all times.

As noted previously, the weighting and balancing system 10, in relation to professional golfers especially, may also be used in the more permanent context of the fitting of golf clubs. The system 10 provides a much simpler method of determining the optimum balance and weighting for the manufacture or assembly of "permanently" adjusted golf clubs than is presently available, and thus the system 10 has an equally important application in this regard.

Because of the simplicity and convenience with which the weighting and balancing system of the present invention may be implemented, and for numerous other reasons as set forth previously herein, it is expected that the industrial applicability and commercial utility of the present invention will be extensive and long lasting.

What is claimed is:

1. A golf club adapted to be utilized with a full swing, comprising:

a wood type club head having a front striking surface and a bottom surface;

eccentric weighting means for adjusting the balance and weight of the golf club, said eccentric weighting means including at least one eccentric weight, the at least one eccentric weight being of a non-dynamic character so as not to impart additional force to a golf ball when struck by said club head; and mounting means for rotatably mounting said eccentric weighting means in association with the bottom surface.

2. The golf club of claim 1, wherein the bottom surface includes a recess within which said eccentric weighting means is located.

3. The golf club of claim 1, wherein the eccentric weight includes a centrally located aperture for accommodating the rotatable mounting about a pin structure.

4. The golf club of claim 1, wherein the eccentric weight has the form of an eccentrically weighted disk.

5. The golf club of claim 1, further including holding means for preventing rotation of said eccentric weighting means during play.

6. The golf club of claim 1, further including a removable sole plate received by the bottom surface, the sole plate having an interior surface.

7. The golf club of claim 6, wherein said eccentric weighting means and said mounting means include the sole plate, the eccentric weight being constituted by a weight attached to the interior surface of the sole plate at a location radially distant from an approximate sole plate center.

8. The golf club of claim 7, further including the sole plate having a plurality of protrusion features for mateable reception in a plurality of indentation features present in the bottom surface.

9. The golf club head of claim 1 wherein said club head is oversized and has a substantially ellipsoidal shape partially abbreviated by said striking face and further including a sole plate having a convex appearance to define a lower portion of the ellipsoid shape.

10. A golf club head of the wood type having a striking surface and a bottom surface, comprising:

a sole plate having an interior surface;

mounting means for rotatably mounting said sole plate in association with said bottom surface; and eccentric weighting means for adjusting the balance and weight of the golf club, said eccentric weighting means including said rotatable sole plate.

11. The golf club head of claim 10 wherein said eccentric weighting means further includes at least one weight attached to the interior surface of said sole plate at a location radially distant from an approximate sole plate center.

12. The golf club head of claim 10 wherein said sole plate includes an aperture structure and said mounting means includes a pivot pin received by the aperture structure about which said sole plate may rotate.

13. The golf club head of claim 10 wherein said mounting means includes said sole plate having a plurality of protrusion features for mateable reception in a plurality of indentation features present in said bottom surface.

14. The golf club head of claim 10 wherein said golf club head is oversized and has a substantially ellipsoidal shape partially abbreviated by said striking face and wherein said sole plate has a convex appearance to define a lower portion of the ellipsoid shape.

15. In a golf club having an oversized, wood-type club head, said club head having a substantially planar striking face, a heel, a top surface, a bottom surface, a top surface view orientation, and a mass, the top surface having a geometric center point, the improvement comprising:

said club head shaped to distribute at least fifty percent of the mass of the club head, as viewed from the top surface view orientation, heelward of the geometric center point of the top surface and at least one non-dynamic eccentric weight which is rotatable mounted in a substantially horizontal plane for adjusting the balance and weight of the golf club.

16. The improved golf club of claim 15 wherein said oversized club head has a substantially ellipsoidal shape that is partially abbreviated by said striking face.

17. The improved golf club of claim 15 further including said golf club head having an interior portion.

18. The improved golf club of claim 17 further including mounting means for rotatably mounting the eccentric weight within the interior portion.

19. The improved golf club of claim 18 further including a sole plate having an interior surface, and wherein the mounting means provides a rotatable mounting of the sole plate in association with said bottom surface, the eccentric weight including the rotatable sole plate.

* * * * *